US012780519B2

(12) United States Patent
Shimizu

(10) Patent No.: US 12,780,519 B2
(45) Date of Patent: Nov. 3, 2026

(54) CARRIER TAPE

(71) Applicant: Murata Manufacturing Co., Ltd., Nagaokakyo (JP)

(72) Inventor: Yasuhiro Shimizu, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 18/618,150

(22) Filed: Mar. 27, 2024

(65) Prior Publication Data

US 2024/0239581 A1 Jul. 18, 2024

Related U.S. Application Data

(63) Continuation of application No. PCT/JP2023/011237, filed on Mar. 22, 2023.

(30) Foreign Application Priority Data

Apr. 20, 2022 (JP) ..... 2022-069287

(51) Int. Cl.
*B65D 73/02* (2006.01)

(52) U.S. Cl.
CPC ..... *B65D 73/02* (2013.01); *B65D 2585/86* (2013.01)

(58) Field of Classification Search
CPC ..... H05K 13/0084; H01L 21/6836; B65D 2585/86; B65D 73/02
USPC ..... 206/713–711
See application file for complete search history.

(56) References Cited

U.S. PATENT DOCUMENTS 4,736,841 A * 4/1988 Kaneko ..... H05K 13/0084 220/555
4,781,953 A * 11/1988 Ball ..... H05K 13/0038 428/36.8
5,115,911 A * 5/1992 Schulte ..... B65D 73/02 206/390
5,234,104 A * 8/1993 Schulte ..... H05K 13/0084 206/390
6,003,676 A * 12/1999 Beyer ..... H05K 13/0084 206/725

(Continued)

FOREIGN PATENT DOCUMENTS

JP H0487971 A 3/1992
JP 2006160370 A 6/2006

(Continued)

OTHER PUBLICATIONS

International Search Report in PCT/JP2023/011237, mailed May 16, 2023, 3 pages.

(Continued)

*Primary Examiner* — Chun Hoi Cheung
(74) *Attorney, Agent, or Firm* — Keating & Bennett, LLP

(57) ABSTRACT

A carrier tap has a belt shape and includes material forming layers laminated in a lamination direction, a front surface and a back surface opposed to each other in a height direction corresponding to the lamination direction, and accommodating portions that each accommodate a component. The accommodating portions are each adjacent to the front surface and each aligned along a length direction with a partition wall interposed therebetween. The partition wall includes a top lower in height than a top of the front surface.

16 Claims, 5 Drawing Sheets

(56) References Cited

U.S. PATENT DOCUMENTS

| | | | | |
|---|---|---|---|---|
| 6,216,419 | B1 * | 4/2001 | Sakurai | B65B 9/045 53/139.5 |
| 6,467,627 | B1 * | 10/2002 | Troxtell, Jr. | B65D 73/02 206/713 |
| 7,584,853 | B2 * | 9/2009 | Yoshii | H05K 13/0084 206/813 |
| 7,611,016 | B2 * | 11/2009 | Wihren | A61P 29/00 206/519 |
| 10,315,821 | B2 * | 6/2019 | Zaal | H01L 21/6836 |
| 2004/0040886 | A1 * | 3/2004 | Tellkamp | H05K 13/0084 206/714 |
| 2008/0087572 | A1 * | 4/2008 | Wihren | H05K 13/0084 264/554 |
| 2008/0296201 | A1 * | 12/2008 | Lalouch | H05K 13/0084 206/713 |
| 2012/0037538 | A1 * | 2/2012 | Tokoi | H05K 13/0084 264/156 |
| 2023/0271761 | A1 * | 8/2023 | Naba | B65D 75/28 206/713 |

FOREIGN PATENT DOCUMENTS

| | | | |
|---|---|---|---|
| JP | 2006272952 | A | 10/2006 |
| JP | 2013227065 | A | 11/2013 |
| JP | 2014061944 | A | 4/2014 |
| JP | 2021130292 | A | 9/2021 |

OTHER PUBLICATIONS

Written Opinion in PCT/JP2023/011237, mailed May 16, 2023, 3 pages.

* cited by examiner

CARRIER TAPE

CROSS REFERENCE TO RELATED APPLICATIONS

This application claims the benefit of priority to Japanese Patent Application No. 2022-069287 filed on Apr. 20, 2022 and is a Continuation Application of PCT Application No. PCT/JP2023/011237 filed on Mar. 22, 2023. The entire contents of each application are hereby incorporated herein by reference.

BACKGROUND OF THE INVENTION

1. Field of the Invention

The present invention relates to carrier tapes suitable for use in transportation or storage of a large number of components such as chip-shaped electronic components.

2. Description of the Related Art

In the related art, when small electronic components such as semiconductor chips or capacitor chips are transported, a large number of electronic components are contained in a belt-shaped long carrier tape, and the carrier tape is wound around a reel to carry the carrier tape together with the reel. This type of carrier tape has recessed accommodating portions for accommodating electronic components one by one on the front side along the length direction, and a cover tape is attached to the front surface to enclose the electronic components in the accommodating portions. Japanese Unexamined Patent Application Publication No. 2014-061944 discloses a carrier tape in which paper is used as a base material and a large number of accommodating portions are provided on the surface of the base material by a molding die.

SUMMARY OF THE INVENTION

The accommodating portions are separated by partition walls. A large number of electronic components are efficiently accommodated if the thicknesses of the partition walls defining the intervals between the accommodating portions and the pitches of the accommodating portions are both reduced. However, if the thickness of the partition walls is reduced to, for example, about 0.3 mm, when press molding is performed using a molding die on a carrier tape made of paper having a layer structure, interlayer peeling tends to occur at the partition walls. If such interlayer peeling occurs, fine debris or paper dust is generated as a foreign substance from the peeling portion, and the foreign substance may adversely affect the electronic components.

Example embodiments of the present invention provide carrier tapes that are each able to reduce or prevent the occurrence of interlayer peeling at partition walls between accommodating portions for accommodating components.

An example embodiment of the present invention provides a carrier tape including a belt shape body including material including layers laminated in a lamination direction, a front surface and a back surface opposed to each other in a height direction corresponding to the lamination direction, and a plurality of accommodating portions that each accommodate a component, the plurality of accommodating portions each being adjacent to the front surface and each aligned along a length direction with a partition wall interposed therebetween, in which the partition wall includes a top that is lower than a top of the front surface in the height direction.

According to example embodiments of the present invention, it is possible to provide carrier tapes that are each able to reduce or prevent the occurrence of interlayer peeling at partition walls between accommodating portions to accommodate components.

The above and other elements, features, steps, characteristics and advantages of the present invention will become more apparent from the following detailed description of the example embodiments with reference to the attached drawings.

DETAILED DESCRIPTION OF THE EXAMPLE EMBODIMENTS

Figure 1:
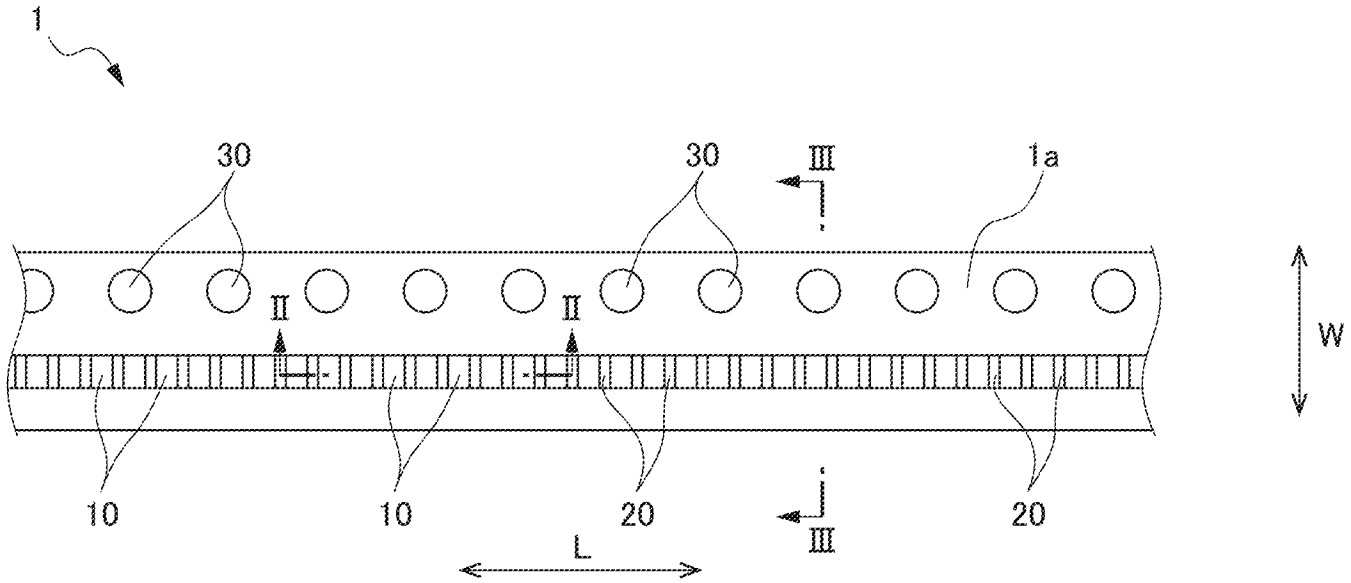
FIG. 1 is a plan view of a portion of a carrier tape according to an example embodiment of the present invention.
Figure 2:
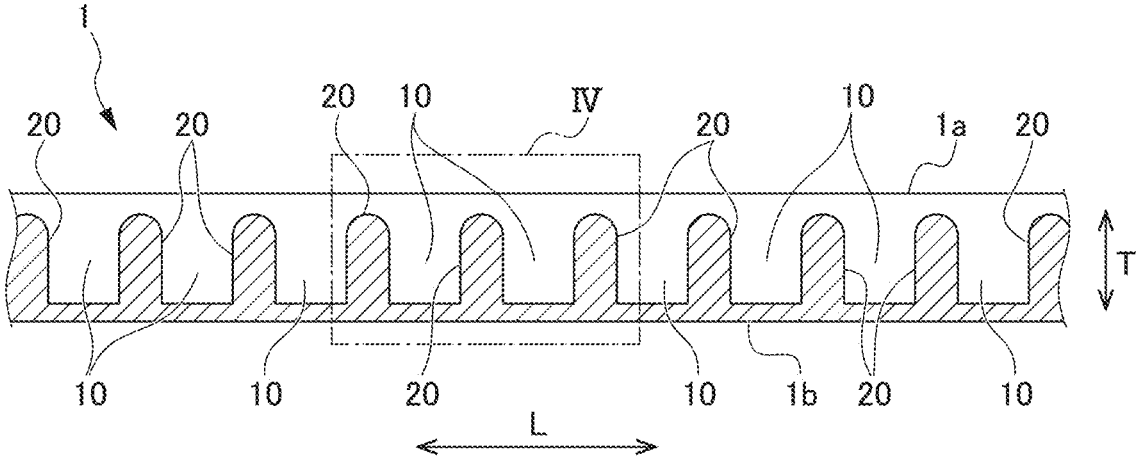
FIG. 2 is a cross-sectional view taken along the line II-II of FIG. 1.
Figure 3:
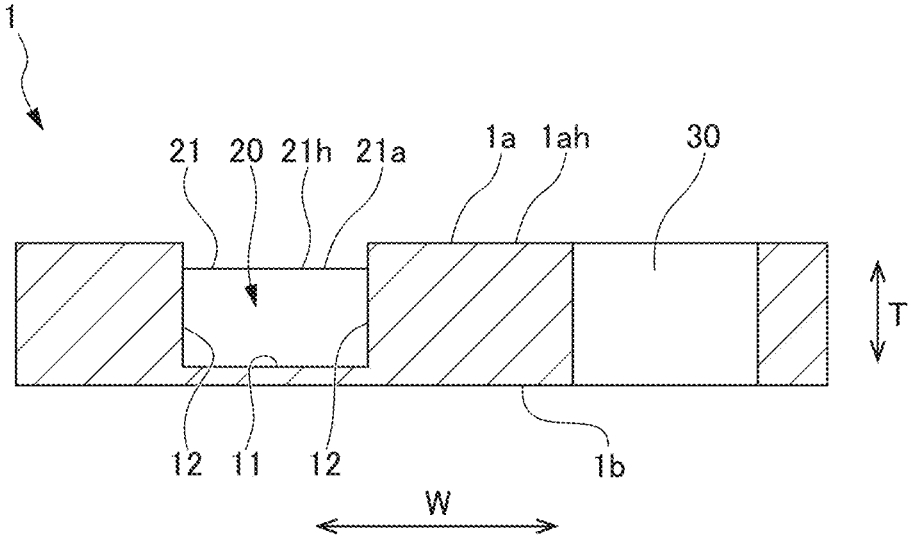
FIG. 3 is a cross-sectional view taken along the line III-III of FIG. 1.
Figure 4:
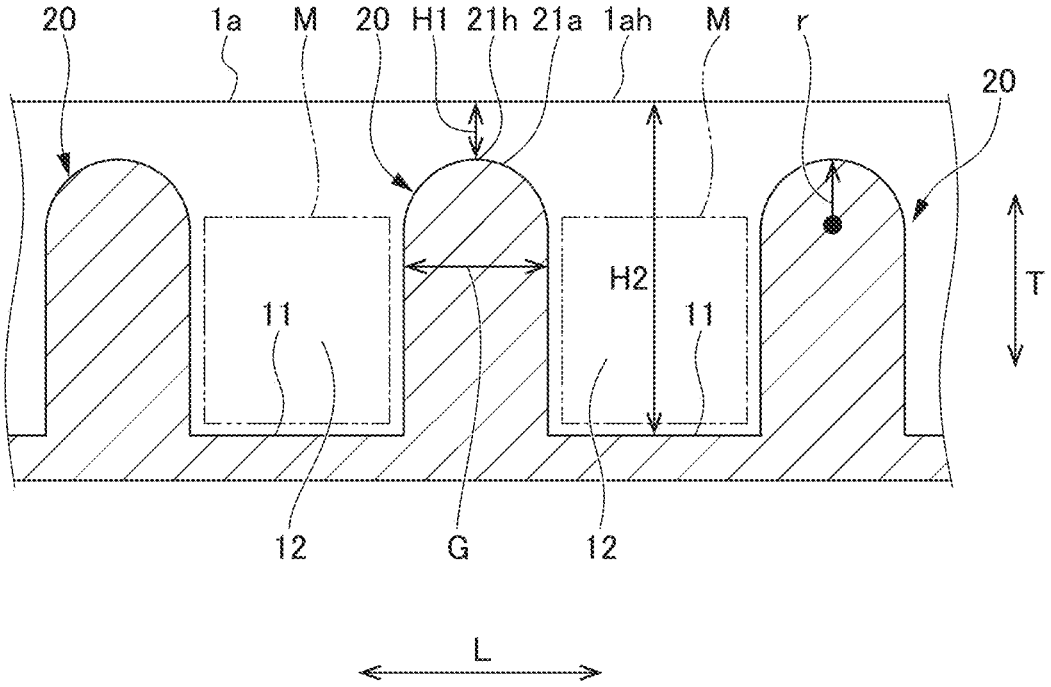
FIG. 4 is an enlarged view of a portion IV in FIG. 2.

Hereinafter, example embodiments will be described with reference to the drawings. FIG. 1 is a plan view of a carrier tape 1 according to an example embodiment of the present invention. FIG. 2 is a cross-sectional view taken along the line II-II of FIG. 1. FIG. 3 is a cross-sectional view taken along the line of FIG. 1. FIG. 4 is an enlarged view of a portion IV in FIG. 2.

The carrier tape 1 according to the present example embodiment has a belt or strip shape and is made of paper, for example, which is a laminated material including layers in the thickness direction. The paper of the carrier tape 1 is a so-called laminated paper, and is formed by laminating a plurality of sheets of paper in the lamination direction and bonding them together. In FIGS. 1 to 4, the length direction of the carrier tape 1 is defined as L, the width direction orthogonal or substantially orthogonal to the length direction L is defined as W, and the height direction orthogonal or substantially orthogonal to the length direction L and the width direction W is defined as T. The lamination direction corresponds to the height direction of the carrier tape 1. In the following description, the length direction, the width direction, and the height direction refer to directions indicated by L, W, and T, respectively. The height direction T is the same as the thickness direction of the carrier tape 1. Hereinafter, the height direction may be referred to as a thickness direction.

The carrier tape 1 includes a front surface 1*a* and a back surface 1*b* opposed to each other in the height direction. The front surface 1*a* and the back surface 1*b* are both flat surfaces and are parallel or substantially parallel to each other. The distance between the front surface 1*a* and the back surface 1*b* is the maximum distance in the height direction of the carrier tape 1. In other words, the distance between the front surface 1*a* and the back surface 1*b* refers to the thickness of the carrier tape 1.

The front surface 1*a* of the carrier tape 1 includes a plurality of accommodating portions 10. The plurality of accommodating portions 10 are provided at equal or substantially equal pitches along the length direction at positions offset toward one end in the width direction of the carrier tape 1. The front surface 1*a* of the carrier tape 1 includes a plurality of feed holes 30 provided at equal pitches along the length direction on the other end opposite to the one end in the width direction in which the plurality of accommodating portions 10 are provided. Each of the feed holes 30 is a circular or substantially circular through hole penetrating from the front surface 1*a* to the back surface 1*b*.

Each of the plurality of accommodating portions 10 accommodates one component M shown in FIG. 4. The component M is a chip-shaped electronic component having a rectangular or substantially rectangular parallelepiped shape, such as a semiconductor chip or a multilayer ceramic capacitor, but is not limited thereto.

Partition walls 20 to separate the plurality of accommodating portions 10 are provided between the accommodating portions 10 adjacent to each other in the length direction. The plurality of accommodating portions 10 are aligned in a line along the length direction with each of the partition walls 20 interposed therebetween.

Each of the accommodating portions 10 is a recess opened toward the front surface 1*a* of the carrier tape 1. Each of the accommodating portions 10 includes a rectangular or substantially rectangular internal space corresponding to the component M to be accommodated. As shown in FIGS. 3 and 4, each of the accommodating portions 10 includes a bottom portion 11, a pair of lateral wall portions 12 on both sides in the width direction, and a pair of partition walls 20 on both sides in the length direction and is surrounded by them. The pair of lateral wall portions 12 are opposed to each other in the width direction, and the pair of partition walls 20 are opposed to each other in the length direction.

Each of the pair of lateral wall portions 12 of the accommodating portion 10 is a flat surface along the length direction and the height direction. Each of the pair of lateral wall portions 12 stands substantially vertically from both end edges in the width direction of the bottom portion 11 to be directly continuous with the front surface 1*a*. That is, when the carrier tape 1 is viewed from above as shown in FIG. 1, both sides of the recess 10 in the width direction have the front surface 1*a*, and no portion separating each of the accommodating portions 10 from the front surface 1*a* exists.

As shown in FIG. 3, each of the partition walls 20 has a rectangular or substantially rectangular shape when viewed from the front in the length direction. Each of the partition walls 20 includes a top 21 extending straight or substantially straight in the width direction. The top 21 is an end portion adjacent to the front surface 1*a* of each of the partition walls 20. In the height direction, the height position 21*h* of the top 21 is lower than the height position 1*ah* of the front surface 1*a*. That is, the top 21 of the partition wall 20 does not exist in the same plane as the front surface 1*a*, but is recessed toward the bottom portion 11 from the front surface 1*a* . In addition, the height position 21*h* of the top 21 refers to the highest position of the top 21 closest to the front surface 1*a* in the height direction.

As shown in FIG. 4, the dimension of recess H1, that is, the distance H1 in the height direction from the top 21 to the front surface 1*a*, is preferably about 5% or more and about 30% or less of the depth H2 of each of the accommodating portions 10. The depth H2 of each of the accommodating portions 10 is a dimension in the height direction from the bottom portion 11 to the front surface 1*a*, and refers to a height of each of the lateral wall portions 12.

In the present example embodiment, the thickness G, which is the dimension in the length direction of each of the partition walls 20, is not limited, but is, for example, about 0.2 mm or more and about 0.45 mm or less. When each of the partition walls 20 has such a small thickness G, the pitches of the plurality of accommodating portions 10 are reduced, and the number of accommodating portions 10 can be increased, such that it is possible to efficiently accommodate a large number of components M. Such a configuration is preferable.

As shown in FIG. 4, the cross-sectional shape of each of the tops 21 along the length direction and the height direction is in a round or substantially round shape (R-shaped) which is convex toward the front surface 1*a*. That is, the side cross-sectional shape of a top surface 21*a* of each of the partition walls including the top 21 has a semi-arc shape. The radius r of the top surface having such a round or substantially round shape is, for example, about 0.1 mm or more and about 1.5 mm or less.

Figure 5:
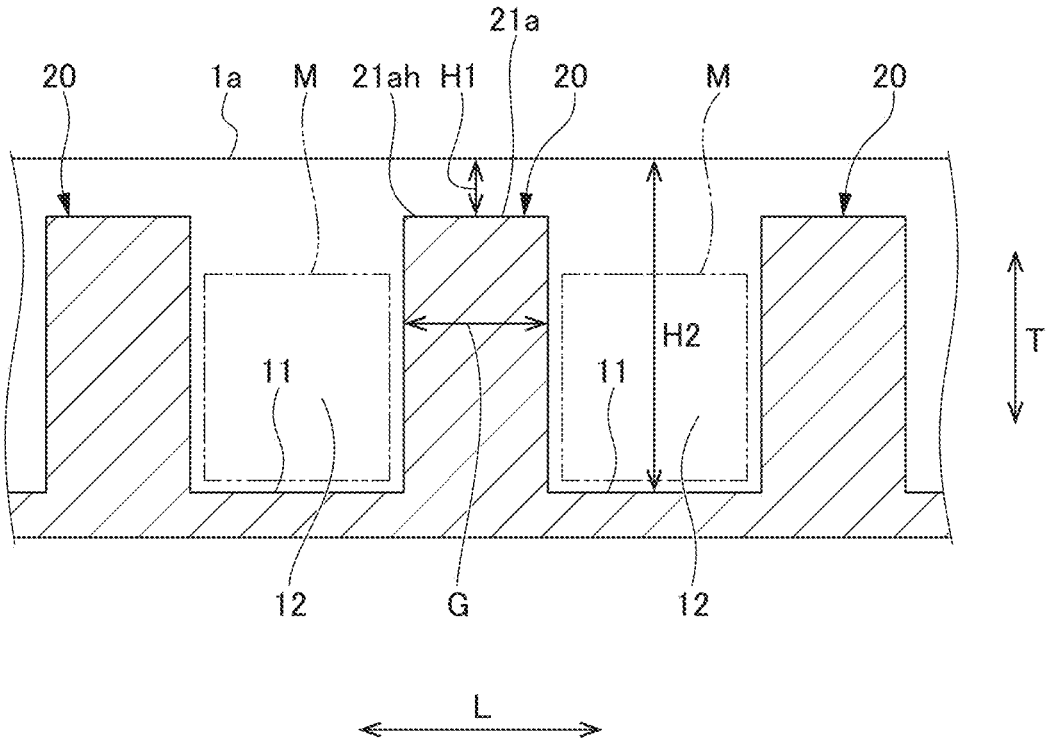
FIG. 5 is a cross-sectional view of another example embodiment of a partition wall according to an example embodiment of the present invention, and corresponds to FIG. 4.

The cross-sectional shape of the top 21 of each of the partition walls 20 may not be in such a round or substantially round shape. For example, as shown in FIG. 5, the top 21 of the partition wall 20 may have a rectangular or substantially rectangular cross-sectional shape along the length direction and the height direction, and the top surface 21*a* of the top 21 may have a flat surface along the length direction and the width direction.

In the carrier tape 1 according to the present example embodiment, the accommodating portion 10 and the partition wall 20 are formed at the same time by pressing a molding die against the front surface 1*a* of a material made of belt-shaped laminated paper for press-molding. At the time of press-molding, the partition wall 20 is compressed in the height direction and the thickness direction from the material state. Therefore, the degree of compression of each of the partition walls 20 is higher than that of the other portions, and the density of each of the partition walls 20 is higher than that of the other portions other than the partition walls 20. Further, since the density is high, the hardness of each of the partition walls 20 is higher than that of the other portions.

In the carrier tape 1 of the present example embodiment, one component M is accommodated in each of the plurality of accommodating portions 10, and a cover tape (not shown) to seal the plurality of accommodating portions 10 is attached to the front surface 1*a*. With such a configuration, the component M is sealed in each of the plurality of the accommodating portions 10 without falling off. The carrier tape 1 in which one component M is accommodated in each of the plurality of accommodating portions 10 is wound around a reel (not shown), and is transported or stored. Then, in the carrier tape 1, the cover tape is peeled off while being unwound from the reel at a supply destination or the like of the components M, and the components M are picked up from the accommodating portion 10 and used. When the carrier tape 1 is unwound from the reel, the teeth of the rotating conveying sprocket are sequentially engaged with the feed hole 30. Thus, the carrier tape 1 is unwound from the reel, and the plurality of components M are conveyed in the unwinding direction.

The carrier tapes 1 according to the example embodiments achieve the following advantageous effects.

According to an example embodiment of the present invention, the carrier tape 1 has a belt shape and includes material forming layers laminated in a lamination direction.

The carrier tape 1 includes the front surface 1*a* and the back surface 1*b* opposed to each other in the height direction corresponding to the lamination direction, and the plurality of accommodating portions 10 that each accommodate a component M. The plurality of accommodating portions 10 are each adjacent to the front surface 1*a* and each aligned along the length direction with the partition wall 20 interposed therebetween. The partition wall 20 includes the top 21, and a height position of the top 21 is lower than a height position of the front surface 1*a* in the height direction.

With such a configuration, since the height of each of the partition walls 20 is smaller than the height of the carrier tape 1, i.e., the thickness of the carrier tape 1, it is possible to reduce the occurrence of interlayer peeling as compared with the case of the same height as the thickness of the carrier tape 1. In other words, interlayer peeling is less likely to occur in the partition walls 20.

In the carrier tape 1 according to an example embodiment of the present invention, it is preferable that the distance H1 from the top 21 to the front surface 1*a* in the height direction is about 5% or more and about 30% or less of the depth H2 of each of the plurality of accommodating portions 10, for example.

With such a configuration, the height of each of the partition walls 20 can be maintained to such an extent that the component M accommodated in each of the accommodating portions 10 does not move beyond each of the partition walls 20 disadvantageously, such that it is possible to achieve the advantageous effect of reducing or preventing interlayer peeling due to being low in height.

In the carrier tape 1 according to an example embodiment of the present invention, each of the partition walls 20 preferably has a thickness of about 0.2 mm or more and about 0.45 mm or less, for example.

With such a configuration, the pitches of the plurality of accommodating portions 10 are reduced and the number of accommodating portions 10 increases such that it is possible to efficiently accommodate a large number of components M.

In the carrier tape 1 according to an example embodiment of the present invention, it is preferable that a cross-sectional shape of the top 21 along the length direction and the height direction is round or substantially round and convex toward the front surface 1*a*.

For example, when the side cross-sectional shape of the top 21 is rectangular and includes a corner, delamination is likely to occur at such a corner, and accordingly interlayer peeling or burring is likely to occur. However, with the top 21 having a round or substantially round shape, such a disadvantage is less likely to occur. In other words, with the top 21 having a round or substantially round shape, it is possible to reduce or prevent the occurrence of interlayer peeling or burring at the top 21.

In the carrier tape 1 according to an example embodiment of the present invention, it is preferable that a density of each of the partition walls 20 is higher than that of the other portions other than the partition walls 20.

With such a configuration, the layer of each of the partition walls 20 becomes dense, such that it is possible to further reduce or prevent the occurrence of interlayer peeling.

While example embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A carrier tape comprising:

a belt shape body including material made of paper and including layers laminated in a lamination direction;

a front surface and a back surface opposed to each other in a height direction corresponding to the lamination direction; and a plurality of accommodating portions that each accommodate a component, the plurality of accommodating portions each being adjacent to the front surface and each aligned along a length direction with a partition wall interposed therebetween; wherein the partition wall includes a top that is lower than a top of the front surface in the height direction; and a density of the partition wall is higher than that a density of portions of the carrier tape other than the partition wall.

2. The carrier tape according to claim 1, wherein a distance from the top of the partition wall to the front surface in the height direction is about 5% or more and about 30% or less of a depth of each of the plurality of accommodating portions.

3. The carrier tape according to claim 1, wherein the partition wall has a thickness of about 0.2 mm or more and about 0.45 mm or less.

4. The carrier tape according to claim 1, wherein a cross-sectional shape of the top of the partition wall along the length direction and the height direction is round or substantially round and convex toward the front surface.

5. The carrier tape according to claim 1, wherein the belt shape body is made of paper.

6. The carrier tape according to claim 1, wherein the layers are sheets of paper.

7. The carrier tape according to claim 1, further comprising a plurality of feed holes in each of which a respective one of the plurality of accommodating portions is provided.

8. The carrier tape according to claim 7, wherein the plurality of feed holes are circular or substantially circular.

9. The carrier tape according to claim 1, wherein the plurality of accommodating portions are shaped to accommodate a chip-shaped electronic component having a rectangular or substantially rectangular parallelepiped shape.

10. The carrier tape according to claim 1, wherein the plurality of accommodating portions are shaped to accommodate a semiconductor chip or a multilayer ceramic capacitor.

11. The carrier tape according to claim 1, wherein the plurality of accommodating portions includes a rectangular or substantially rectangular internal space.

12. The carrier tape according to claim 1, wherein each of the plurality of accommodating portions includes a bottom portion, a pair of lateral wall portions, and a pair of the partition walls.

13. The carrier tape according to claim 12, wherein a cross-sectional shape of the top of each of the pair of partition walls is round or substantially round.

14. The carrier tape according to claim 13, wherein a radius of a surface of the top of each of the pair of partition walls is about 0.1 mm or more and about 1.5 mm or less.

15. The carrier tape according to claim 12, wherein a cross-sectional shape of the top of each of the pair of partition walls is a semi-arc shape or a rectangular or substantially rectangular shape.

16. The carrier tape according to claim 1, wherein a portion of the back surface that overlaps each of the partition wall and at least one of the plurality of accommodating portions is flat or substantially flat.

* * * * *